United States Patent [19]

Whited et al.

[11] Patent Number: 5,057,002

[45] Date of Patent: Oct. 15, 1991

[54] BEAD SHAPER

[76] Inventors: Preston D. Whited, 2008 Milford St., Winston-Salem, N.C. 27107; Ralph T. Hayes, Jr., P.O. Box 708, Clemmons, N.C. 27012

[21] Appl. No.: 505,485

[22] Filed: Apr. 6, 1990

[51] Int. Cl.[5] ..... B29C 59/02; B05C 17/10

[52] U.S. Cl. ..... 425/458; 15/235.7

[58] Field of Search ..... 425/87, 458, ; 15/235.3, 235.7

[56] References Cited

U.S. PATENT DOCUMENTS

| | | | |
|---|---|---|---|
| 503,098 | 8/1893 | Newton | 30/169 |
| 684,576 | 10/1901 | Lucas | 15/235.7 |
| 835,160 | 11/1906 | Lutz et al. | 15/144 |
| 888,629 | 5/1908 | MacLaughlin | 425/458 |
| 980,177 | 12/1910 | Koschke | 425/458 |
| 1,091,370 | 3/1914 | Menke | 425/458 |
| 1,927,202 | 9/1933 | Burdick | 15/236.01 |
| 2,594,606 | 4/1952 | Ames | 425/87 |
| 2,674,005 | 4/1954 | Simon | 15/105 |
| 2,809,513 | 10/1957 | Ames | 425/87 |
| 2,824,443 | 2/1958 | Ames | 425/87 |
| 3,105,262 | 10/1963 | Lathrop et al. | 15/235.7 |
| 3,744,079 | 7/1973 | Krause | 15/235.7 |
| 3,761,992 | 10/1973 | Schneller | 15/210 R |
| 3,846,060 | 11/1974 | Otis | 425/458 |
| 4,202,093 | 5/1980 | Wallerstein | 15/236.01 |
| 4,258,898 | 3/1981 | Tuzzolino | 249/119 |
| 4,451,223 | 5/1984 | Mower et al. | 425/458 |
| 4,586,890 | 5/1986 | Marchbanks | 425/458 |
| 4,619,013 | 10/1986 | Yon | 15/235.8 |

*Primary Examiner*—Willard E. Hoag

*Attorney, Agent, or Firm*—Wigman & Cohen

[57] ABSTRACT

An apparatus for shaping beads of fluent material such as caulking, grout or putty. A first preferred embodiment of the present invention is a bead shaper which has an essentially rectangular shaper blade mounted in a holder having a swivelable handle. The shaper blade has a number of notches which are adapted to receive a skid disposed essentially transverse to the longitudinal axis of the shaper blade. The shaper blade has a plurality of bead shaper edges at its four corners, each of which provides a different bead shape. The bead shaper is operated by placing the shaper blade against and perpendicular to the joined surfaces which have been caulked. The skid rests against one or both of these surfaces. The bead shaper edge rests on the caulking bead. The shaper blade is run along the caulking bead, forming the bead and pushing the excess caulking material forward of the blade and also scraping away any excess that is forced off to the sides of the bead. When a nonuniformity in the wall surface is contacted, such as a grouted tile seam, the skid or skids maintain the shaper blade position evenly over the bead and thus prevents the bead shaper from forming an indentation in the bead.

20 Claims, 2 Drawing Sheets

FIG. 3
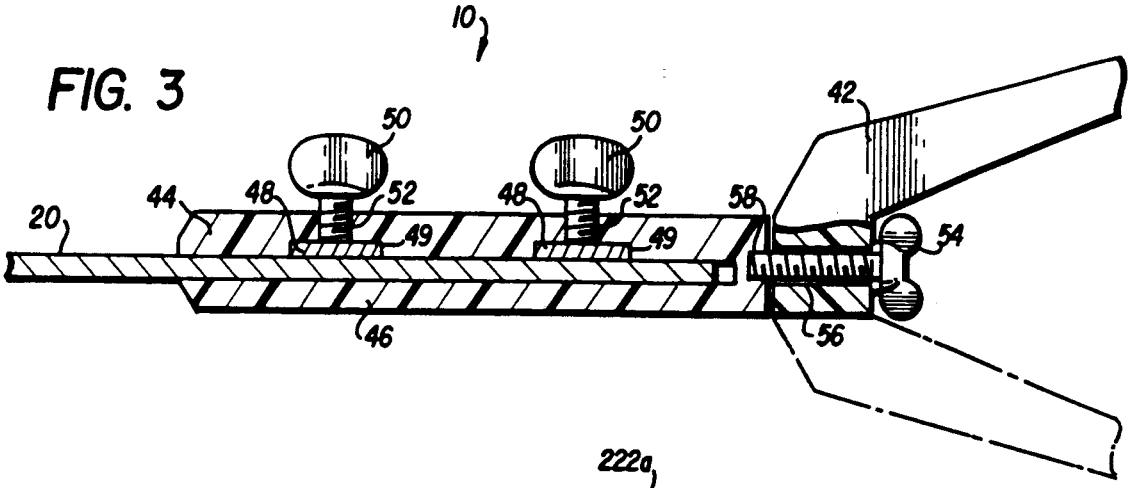
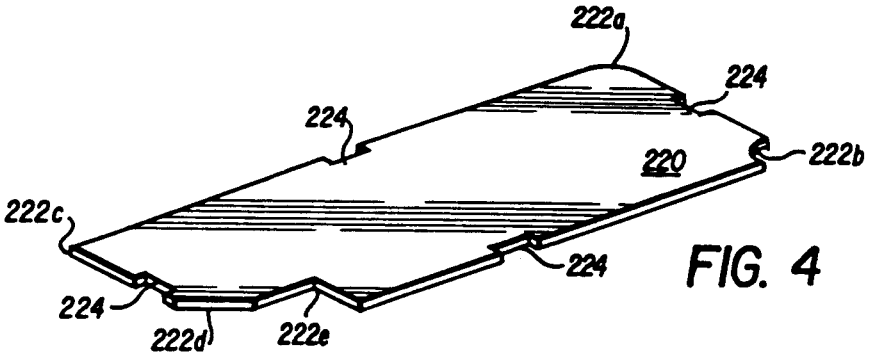
FIG. 4
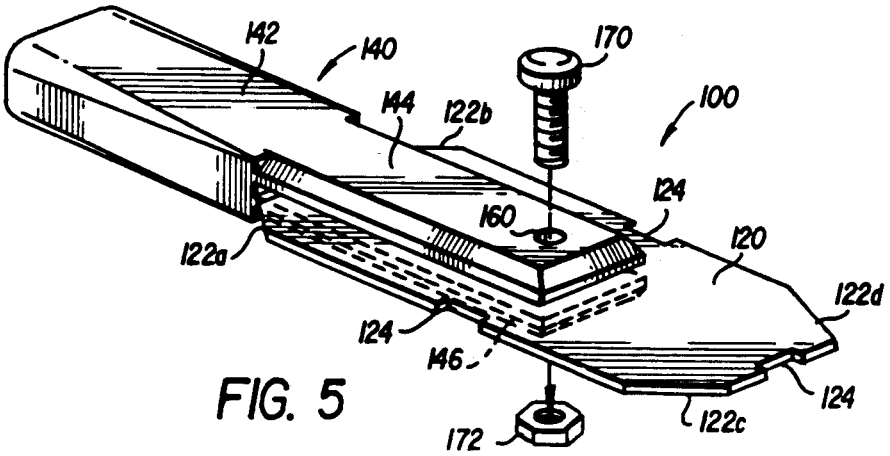
FIG. 5

BEAD SHAPER

FIELD OF THE INVENTION

The present invention relates generally to the shaping of beads of a fluent material, such as caulk, grout or putty, which is inserted at the joint of two intersecting surfaces, such as bathroom tile or a glass pane in a window.

DESCRIPTION OF THE PRIOR ART

Various attempts have been made to form suitable shapes of beads of fluent materials such as caulking, grout or putty. Typically, when bathroom tile is set, the interface between the tub and wall or the corner intersection between two walls is sealed by applying a bead of caulk. Frequently, a caulking gun is used to lay down an essentially cylindrical rod-shaped bead. Such a bead tends to be uneven and unprofessional in appearance. Likewise, when a glass windowpane is mounted in a frame, a bead of putty is used to set and seal the glass to the frame. Typically, a putty knife is used to shape the bead into a triangular cross-section, but the shape of the bead is often uneven.

Heretofore, various tools have been designed to address this problem. Among these is a caulk bead tool disclosed in U.S. Pat. No. 4,586,890, issued to Marchbanks, which shows a hand held tool which is basically a rectangular parallelopiped having a plurality of bead-shaped grooves formed at the edges. The tool is used to run along a rough bead of caulking material, forming a uniform bead and pushing the excess caulking to the sides of the bead and in the direction of motion. This tool has the disadvantage of requiring cleanup along the bead plus being susceptible to misalignment because of the orientation of the grooves on the device.

U.S. Pat. No. 3,761,992, issued to Schaeller, discloses a corner caulking tool which is comprised of a flat, essentially square working head attached to a handle, which is run along the joint to smooth out the caulking bead. The corner edge of the working head determines the shape of the caulking bead. This device has the serious disadvantage that unevenness in the two joining surfaces, such as the grouting seams in a tiled surface could cause the device to change the depth of the bead, thus leading to unsightly discontinuities or indentations which must be removed by hand. The only way to avoid such unevenness would be to orient the working head at an inclined angle to the intersecting surfaces, thus making it difficult to maintain the thickness and uniformity of the bead which would be dependent upon manual dexterity of the user.

U.S. Pat. No. 3,744,079, issued to Krause, shows a flexible caulking cleanup tool of a parallelopiped shape having an essentially diamond-shaped cross-section and including a concave V-shaped scoop or groove therein for picking up excess caulking. The tool is made of a resilient material and has an inclined angle of about 100°, so pressure must be applied by hand to cause the tool to fit between right angle joints. The edge of the tool is beveled so that a shaped bead results. This tool has the disadvantage that it must be deformed to operate, hence the angle and uniformity of the resulting bead are not assured.

U.S. Pat. No. 3,846,060, issued to Otis, shows a troweling tool having legs which straddle the caulking bead and a trailing finger which packs and trowels the caulking bead. This tool has the disadvantage of pushing the excess caulking material to the side of the bead, requiring further cleanup. Also, because the device has discreet legs which contact the joining surfaces, it is susceptible to nonuniformities caused by the device passing over a joint, as in a tile seam.

As a result, it is desirable to provide a tool which provides a uniformly shaped bead of caulking, grout, putty or other fluent material, while at the same time being easy to use and requiring a minimum in cleanup and repeated passes over the same beaded area.

SUMMARY OF THE INVENTION

The present invention is directed to an apparatus for shaping beads of fluent material such as caulking, grout or putty. A first preferred embodiment of the present invention is a bead shaper comprising an essentially rectangular shaper blade mounted in a holder having a swivelable handle. The shaper blade has a number of notches which are adapted to receive one or more skids disposed essentially transverse to the longitudinal axis of the shaper blade. The shaper blade has a plurality of bead shaper edges, one at each of its four corners, and each of which provides a different bead shape.

The bead shaper is operated by placing the shaper blade against and perpendicular to the joined surfaces which have been caulked. The skid or skids rest against one or both of these surfaces. The bead shaper edge rests on the caulking bead. The shaper blade is then run along the caulking bead, forming the bead and pushing the excess caulking material forward of the blade and also scraping away any excess that is forced to the sides of the bead. When a nonuniformity in the wall surface is contacted, such as a grouted tile seam, the skid or skids maintain the shaper blade position evenly over the bead and thus prevent the bead shaper from forming an indentation in the bead. Thus, the invention provides the advantage that a uniform bead is thereby formed and essentially all of the excess caulking is removed, in one step.

In a second preferred embodiment of the bead shaper, the shaper blade is rotatably mounted within the holder.

In each embodiment, various shapes of beads are formed using bead shapers of different profiles.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 3 is a sectional view, taken through section A—A of FIG. of the first embodiment of the bead shaper according to the present invention;

FIG. 4 is a perspective view of a variation of a shaper blade for use with the first embodiment of the bead shaper of the present invention; and FIG. 5 is a partially exploded perspective view of a second embodiment of a bead shaper according to the present invention.

DETAILED DESCRIPTION OF THE INVENTION

Figure 1:
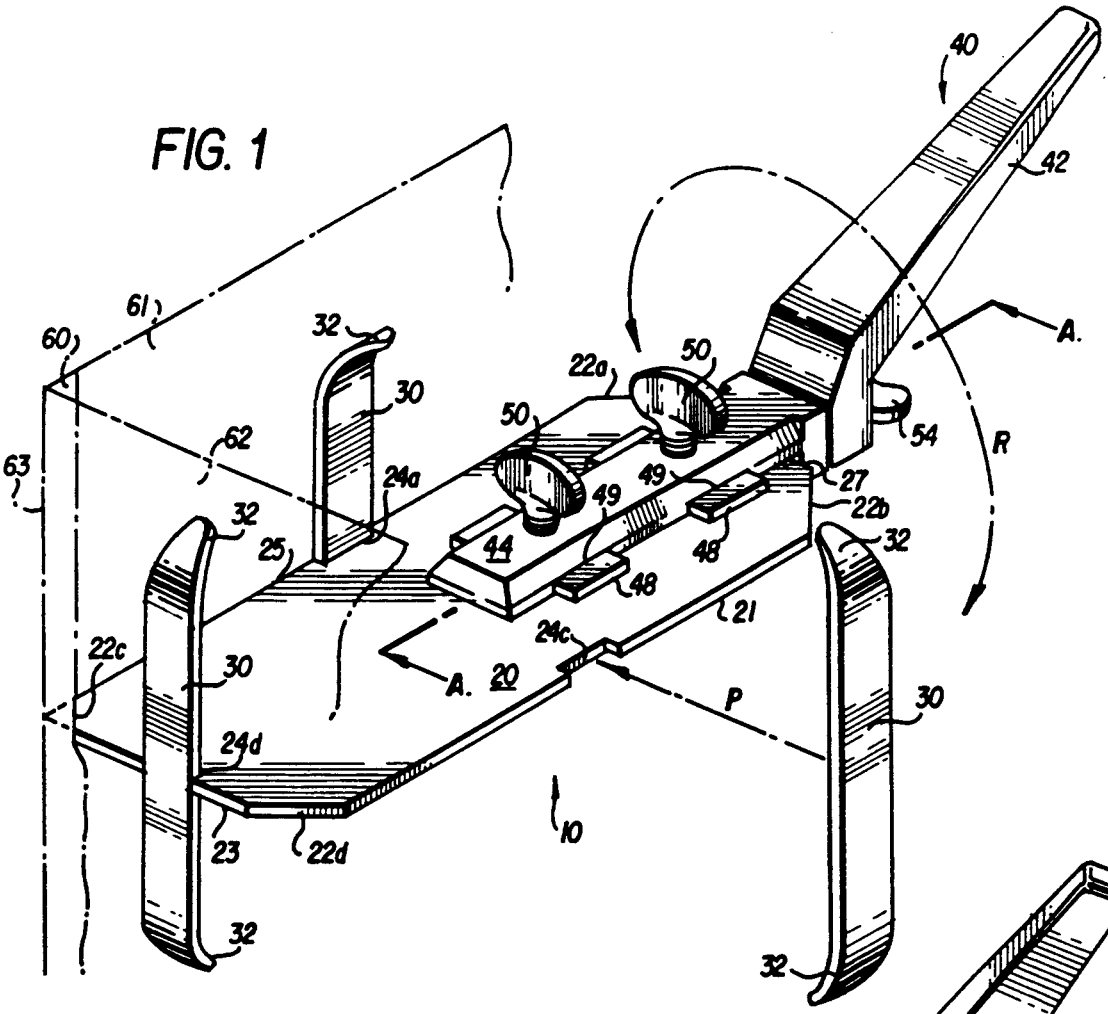
FIG. 1 is a partially exploded perspective view of a first embodiment of a bead shaper according to the present invention.
Figure 2:
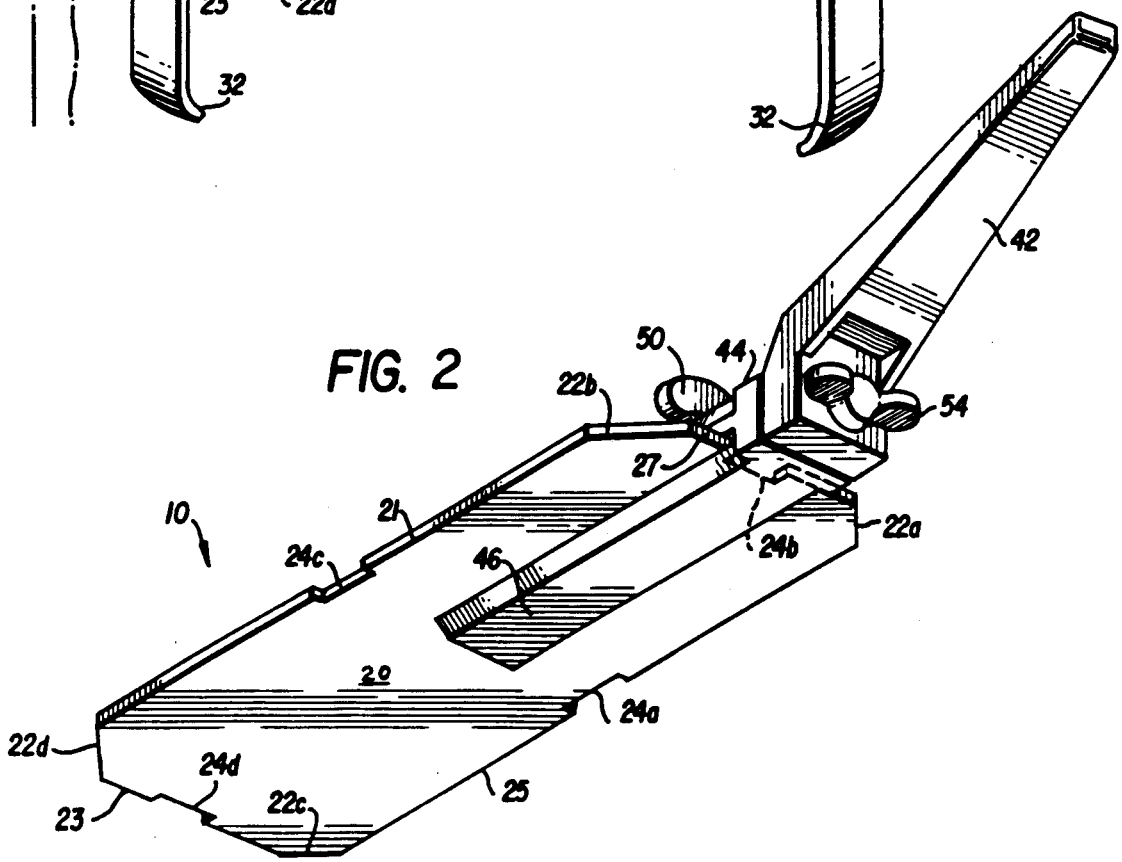
FIG. 2 is another perspective view of the first embodiment of the bead shaper according to the present invention.

Referring now in detail to the drawings wherein like parts are designated by like reference numerals, there is illustrated in FIGS. 1–3 a first preferred embodiment of a bead shaper apparatus of the invention. A bead shaper, generally designated by the numeral 10, is comprised of a shaper blade 20 and a holder 40. The shaper blade 20 is a flat plate having a generally rectangular shape and may be made of metal, plastic or other suitable material. Blade 20 has blade edges 21, 23, 25 and 27 and four bead shaper edges 22*a*–22*d*, each located at a respective corner of the blade between intersecting edges. Approximately midway between the corners of the shaper blade 20 are skid notches 24*a*–24*d*, adapted to receive one or more skids 30. Skid 30 is a flat, ski-shaped, longitudinal member having both ends 32 turned or curved in the same direction as shown. Other suitable shapes of the skid 30 may be used so long as the shaper blade 20 is guided in the manner described herein.

Holder 40 is a member comprised of a swivelable handle 42 and upper and lower holder jaws 44 and 46. Pressure plates 48 are disposed in cutouts or notches 49 in the holder jaw 44. Thumb screws 50 are disposed in threaded holes 52 in holder jaw 44 and bear on pressure plates 48. Handle 42 is swivelably attached to holder jaws 44,46 by a threaded stud 58 which passes through a hole 56 in handle 42. Wing nut 54 is threadably secured to stud 58 and is used to fix handle 42 in an appropriate angular position relative to the holder jaws 44,46.

Bead shaper 10 is assembled as follows: shaper blade 20 is placed between holder jaws 44 and 46, with pressure plates 48 positioned in notches 49 and disposed against shaper blade 20. Shaper blade 20 may be placed with the longitudinal axis thereof either parallel to the longitudinal axis of hold jaws 44 and 46 or transverse to the longitudinal axis of the holder jaws 44 and 46. Thumb screws 50 are tightened against pressure plates 48, compressing shaper blade 20 against holder jaw 46 thereby securely gripping and locking shaper blade 20 between holder jaws 44 and 46. One or more skids 30 are releasably snapped or press fit (arrow P) into one or more of skid notches 24*a*–24*d*. Handle 42 is swiveled by loosening wing nut 54 and rotating handle 42 in the direction shown by arrow R, then retightening using wing nut 54.

FIG. 4 illustrates a shaper blade 220 having skid notches 224 and a variety of bead shaper edges adapted to provide differently shaped beads, including a concave bead edge 222*a*, a convex bead edge 222*b*, a straight bead edge 222*c*, and a beveled windowpane bead edge 222*d* with a substantially right-angle window frame edge 222*e* adjacent thereto.

FIG. 5 illustrates a second embodiment of bead shaper 100, having a different handle arrangement. In this embodiment, a shaper blade 120 having bead shaper edges 122*a*–122*d*, similar to shaper blade 20 described above, is fitted to a holder 140, having a handle 142 and jaws 144 and 146. However, a hole 160 is provided in the center of handle jaws 144 and 146, aligned with a hole (not shown) in shaper blade 120. A bolt 170 and nut 172 are fitted to the hole 160 and tightened to secure the shaper blade 120 to the holder 140. The orientation of the shaper blade 120 can be changed by loosening nut 172, rotating the shaper blade 120 and retightening the nut 172. Shaper blade 120 has skid notches 124 to accommodate skids (not shown) as in the first embodiment.

It will be understood by those skilled in the art that the shaper blade may have shapes other than rectangular for use with surfaces that intersect at angles other than right angles. For example, the shaper blade may be triangular, trapezoidal or any other suitable polygonal shape. The shaper blade may even have curved edges to conform to curved intersecting surfaces.

The operation of the two embodiments is similar and will be described with reference to FIGS. 1–3. The embodiment shown in FIG. 5 would be used in a similar fashion except that the handle is not swivelable and the shaper blade is pivoted about the bolt 170 rather than being translated in two axes as in the first embodiment. Referring to FIG. 1, a bead of caulking 60 or other fluent material is first laid in a seam 63 to be filled, for example, by means of a caulking gun, as is well known in the art. The shaper blade 20 is aligned transverse to the bead direction and the appropriate bead shaper edge 22*c* is placed over the bead 60. The skid 30 is then snapped or press fit into the appropriate skid notch (24*a*, 24*b*, 24*c*, or 24*d*) to align the skid 30 parallel to the bead 60 to be shaped. In some instances, two skids 30 may be placed in adjacent skid notches, such as 24*a* and 24*d*, as shown in FIG. 1, so that a skid 30 will rest against each of two intersecting surfaces 61 and 62. This situation would arise if the two intersecting surfaces 61 and 62 being contacted are each tiled surfaces. The bead shaper 10 is grasped by handle 42, which has been adjusted using wing nut 54, to the appropriate position. Shaper blade 20 is pressed against the mating surfaces 61 and 62 which form the seam to be caulked. This results in two of the shaper blade edges, for example 23 and 25, being pressed against the intersecting surfaces 61 and 62 and the bead shaper edge 22*c* being pressed against the bead 60 to be shaped.

The bead shaper 10 is moved along the bead, with the excess caulking material being pushed ahead, leaving a shaped bead behind. Because the edges of the shaper blade 20 are pressed against the intersecting surfaces, any appreciable excess of the caulking material is wiped away. The skids 30 serve to provide a uniform riding surface for the edge or edges to which they are mounted. As a result, when a seam running transverse to the beaded seam is encountered, as when caulking tiled surfaces, for example, no deviation in bead uniformity results.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. Apparatus for shaping beads of a fluent material laid between the seam of two intersecting surfaces, comprising blade means for shaping the fluent material, said blade means having a plurality of edges, and skid means disposed on at least one of said edges for contacting at least one of said intersecting surfaces, said skid means comprising an elongated member, narrow as compared with the length of an adjacent one of said edges, inserted transversely of said one edge.

2. Apparatus as in claim 1, wherein said blade means includes a plurality of notches on the edges thereof for removably receiving said skid means in press fit engagement.

3. Apparatus as in claim 1, wherein said blade means further comprises a plurality of bead shaping means, each said bead shaping means disposed at a corner of said blade means and each said bead shaping means having a different shape.

4. Apparatus as in claim 1, wherein a pair of said blade means edges are disposed at right angles with respect to one another for scraping.

5. Apparatus as in claim 1, wherein said blade means further comprises at least one bead shaping means having a substantially right angle notch adjacent thereto shaped to conform to the frame of a window.

6. Apparatus as in claim 1, wherein said blade means comprises a substantially flat plate.

7. Apparatus as in claim 6, wherein a longitudinal axis of said skid means is substantially perpendicular to said flat plate.

8. Apparatus as in claim 1, further comprising means for holding said blade means.

9. Apparatus as in claim 8, wherein said blade means is rotatably mounted within said holding means.

10. Apparatus as in claim 8, wherein said blade means is mounted within said holding means by compression.

11. Apparatus as in claim 8, wherein said holding means further comprises a handle means and a jaw means for gripping said blade means, said handle means being swivelable about said jaw means.

12. Apparatus in claim 11, wherein said handle means is swivelable through an angle of 360 degrees about a longitudinal axis passing through said jaw means.

13. Apparatus for shaping beads of a fluent material laid between the seam of two intersecting surfaces, comprising blade means for shaping the fluent material, said blade means having a plurality of edges, and skid means disposed on at least one of said edges for contacting at least one of said intersecting surfaces, said skid means comprising a longitudinal member having its ends formed inwardly toward said blade means.

14. A bead shaper for shaping a fluent material in a seam comprising:

blade means having a plurality of edges intersecting at corners for shaping a bead of fluent material into one of a plurality of shapes defined by the shapes of said corners;

at least one skid means adapted to be removably mounted in at least one edge of said blade means for guiding said blade means along the seam, said skid means comprising an elongated member, narrow as compared with the length of an adjacent one of said edges; and means for holding said blade means.

15. The bead shaper of claim 14, wherein said skid means is releasably mounted to said blade means.

16. The bead shaper of claim 14, wherein said holding means comprises jaw means for gripping said blade means and a handle swivelably mounted to said jaw means.

17. The bead shaper of claim 14, including notch means in the edges of said blade means for receiving said skid means.

18. The bead shaper of claim 17, including a plurality of said skid means to be received in said notch means.

19. Apparatus for shaping beads of a fluent material laid between the seam of two intersecting surfaces, comprising blade means for shaping the fluent material, said blade means having a plurality of edges, and skid means disposed on at least one of said edges for contacting at least one of said intersecting surfaces, said skid means comprising an elongated member having two ends and a longitudinal axis, said elongated member extending transversely across said at least one edge with said two ends thereof spaced respectively in opposite directions from said at least one edge along said axis.

20. Apparatus as in claim 19, wherein said ends of the elongated member are formed inwardly toward said blade means.

* * * * *